United States Patent [19]

Gutschmit

[11] Patent Number: 5,024,393

[45] Date of Patent: Jun. 18, 1991

[54] YARN THREADING APPARATUS FOR TUBE-TYPE TEXTILE YARN CREELS

[75] Inventor: Alan Gutschmit, Troy, N.C.

[73] Assignee: Alandale Industries, Inc., Troy, N.C.

[21] Appl. No.: 516,090

[22] Filed: Apr. 27, 1990

[51] Int. Cl.[5] ..... B65H 49/14

[52] U.S. Cl. ..... 242/131; 226/97

[58] Field of Search ..... 242/131, 131.1, 157 R; 226/97; 66/125 R; 28/190, 193, 198, 199, 212; 57/352, 357, 358

[56] References Cited

U.S. PATENT DOCUMENTS

| | | | |
|---|---|---|---|
| 830,085 | 9/1906 | Land . | |
| 1,031,289 | 7/1912 | Pedley . | |
| 2,661,588 | 12/1953 | Griset, Jr. et al. | 226/97 X |
| 2,846,710 | 8/1958 | Haka . | |
| 3,151,021 | 9/1964 | Balch | 226/97 X |
| 3,303,982 | 2/1967 | Balch | 226/97 |
| 3,683,446 | 8/1972 | Tell . | |
| 3,964,123 | 6/1976 | Pettersson . | |
| 3,967,341 | 7/1976 | Gavin . | |
| 4,492,001 | 1/1985 | Hedrenius . | |
| 4,540,138 | 9/1985 | Gutschmit | 242/131 |
| 4,865,264 | 9/1989 | Goineau | 242/131 |

FOREIGN PATENT DOCUMENTS

| | | | |
|---|---|---|---|
| 2184231 | 12/1973 | France | 226/97 |
| 895866 | 1/1982 | U.S.S.R. | 226/97 |

*Primary Examiner*—Stanley N. Gilreath

*Attorney, Agent, or Firm*—Shefte, Pinckney & Sawyer

[57] ABSTRACT

Apparatus for threading yarns through yarn transport tubes in a tube-type textile yarn creel provides a plurality of valve assemblies operatively communicated to a common source of pressurized air, each valve assembly being mounted to the creel at the entrance end of a respective yarn transport tube for selectively discharging pressurized air into and through the tube when desired to thread a yarn through the tube.

15 Claims, 3 Drawing Sheets

YARN THREADING APPARATUS FOR TUBE-TYPE TEXTILE YARN CREELS

BACKGROUND OF THE INVENTION

The present invention relates generally to textile yarn creels and, more particularly, to such creels of the type wherein a plurality of yarn transport tubes are employed for individually conveying a plurality of yarns from the creel to an associated textile machine or the like.

Over recent years, it has become an increasingly widespread practice in the textile industry throughout the world to utilize tubular conduits to transport textile yarns from one location to another. This practice enables a large number of yarns to be transported together in a relatively compact area while still maintaining the yarns separate from one another. Further, the use of such yarn transporting tubes shields the yarns to prevent accumulation of lint thereon as well as to prevent the release of fibrous lint from the yarns into the ambient atmosphere. For example, a common situation in which yarn transport tubes of this type have been widely used is the feeding of plural yarns from a creel supporting a plurality of yarn packages to a textile machine utilizing the yarns, e.g., a circular knitting machine, such as disclosed in U.S. Pat. No. 4,540,138 for a Textile Yarn Creel. Typically, conventional small-diameter plastic tubing is utilized for such yarn transport tubes.

As will be understood, in initially setting up a creel of the above-described type, it is necessary to thread the individual yarns from the yarn packages supported on the creel through the respective tubes. Likewise, when yarn breakages occur during the ongoing operation of the creel, it is often necessary to rethread the broken yarn through its associated tube. Conventionally, the threading of yarn transport tubes is accomplished by either blowing or sucking a yarn through its associated tube utilizing a conventional hand-held air nozzle connected to a source of pressurized air or to a vacuum source. Specifically, the creel operator initially inserts the leading end of yarn into the end of its associated tube disposed at the creel. When utilizing a pressurized air nozzle, the operator then manually places the nozzle at the same end of the tube and actuates the nozzle to blow the yarn through the tube. When using a suction nozzle, the operator proceeds to the opposite end of the tube at the associated textile machine whereat the operator places the suction nozzle to the opposite end of the tube and actuates the nozzle to suction the yarn through the tube.

While such conventional yarn threading techniques adequately serve the intended purpose, several disadvantages exist. First, the initial set-up of such a tube-type creel is made relatively time consuming by the necessity for the operator to manually thread each tube utilizing a single hand-held air nozzle. Moreover, the hose which necessarily extends from the nozzle to a point of connection with the compressed air or suction source makes it at least somewhat inconvenient and difficult for the operator to manipulate the nozzle and hose assembly in and about the creel and the associated textile machine without disturbing its operating components, this being particularly problematic when threading a broken yarn.

SUMMARY OF THE INVENTION

It is accordingly an object of the present invention to provide an improved apparatus for threading yarns through transport tubes in a textile yarn creel, which avoids the disadvantages of utilizing conventional air nozzles.

The yarn threading apparatus of the present invention is adapted for use in substantially any textile yarn creel of the basic type having a plurality of yarn package support locations and a respective plurality of yarn transport tubes associated therewith. Briefly summarized, the present yarn threading apparatus includes a suitable arrangement for generating a moving gaseous stream, e.g., a source of pressurized air or other gas or a source of suction, and a plurality of selectively openable and closeable fluid-transmitting valve assemblies. Each valve assembly is operatively associated with a respective one of the yarn transport tubes for fluid communication interiorly therewith in the open condition of the valve assembly and each valve assembly is operatively communicated with the gaseous stream generating arrangement for selectively directing a gaseous stream to flow through the respectively associated tube in the open condition of the valve assembly for entraining a yarn at the entrance end of the tube to thread the yarn through the tube.

Preferably, each valve assembly is mounted at the entrance end of its respectively associated tube. Each valve assembly has a valve body which is adapted for retaining the entrance end of the respectively associated tube. The body of each valve assembly is formed with a gas discharge opening directed into the entrance end of its respectively associated tube, the discharge opening preferably being offset laterally from the center of the entrance end of the tube. The body of each valve assembly is also preferably formed with a yarn-receiving slot for supporting a leading end portion of a yarn to be threaded through the associated tube, the discharge opening terminating at the slot for directing the gaseous stream into entraining contact with the yarn. A surface is formed on each valve body for supporting the entrance end of the associated tube in a predetermined position relative to the discharge opening in the valve body.

In a typical embodiment of the present yarn threading apparatus in a textile yarn creel, the creel includes a plurality of upright package-supporting frame members each of which has a plurality of package holder elements spaced therealong and a plurality of upright tube-supporting members laterally spaced from the package-supporting frame members in facing relation thereto. Each valve assembly and the entrance end of its respectively associated tube is mounted to a respective one of the tube-supporting members in laterally adjacent facing relation to a respective one of the holder elements. Each group of valve assemblies mounted along a common tube-supporting member is preferably communicated in series with one another and, in turn, with the gaseous stream generating arrangement.

DESCRIPTION OF THE PREFERRED EMBODIMENT

Figure 1:
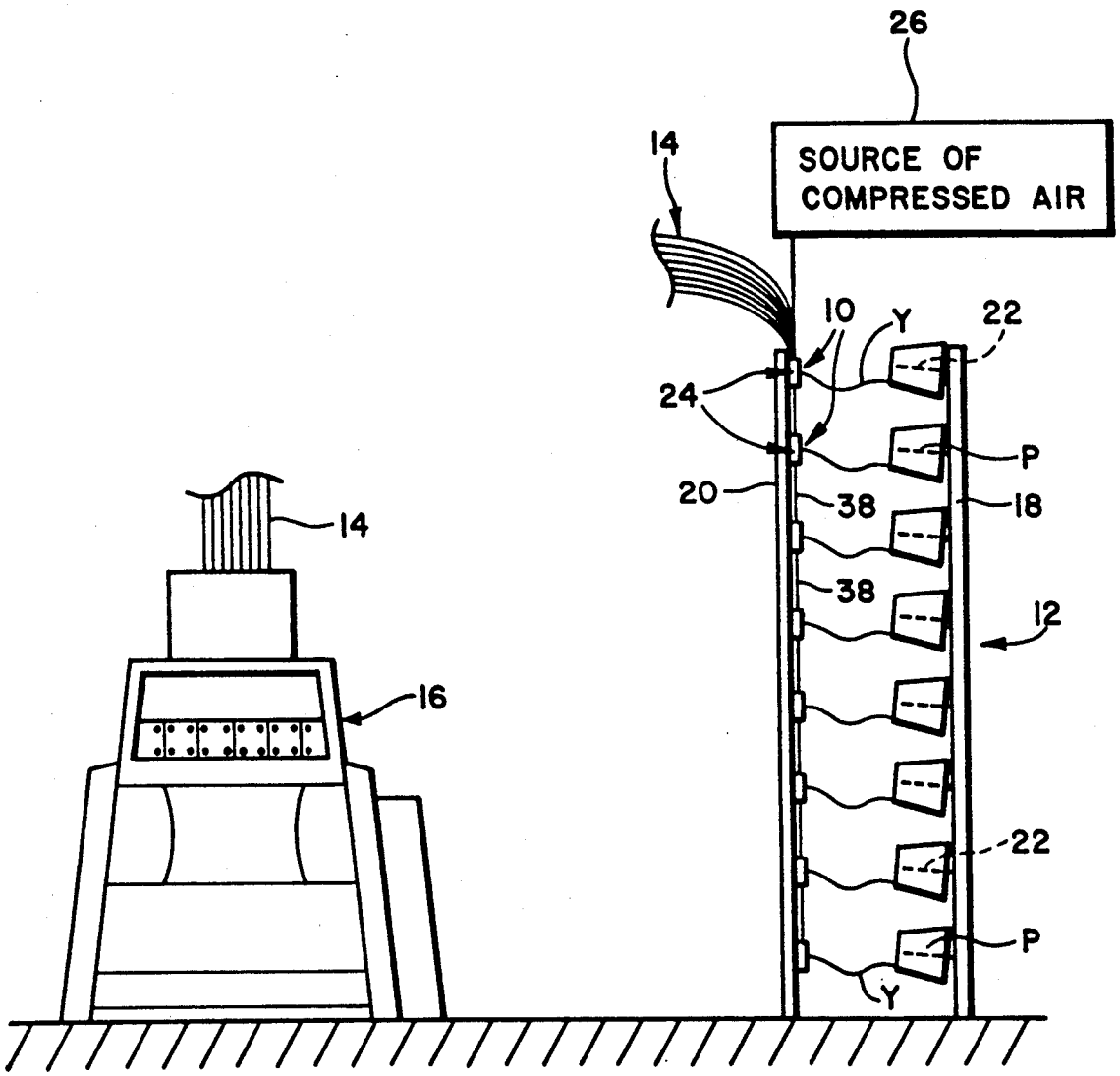
FIG. 1 is a side elevational view schematically illustrating the yarn threading apparatus of the present invention as preferably embodied in a textile yarn creel which supplies multiple yarns to an associated textile circular knitting machine through a corresponding plurality of yarn transport tubes.

Referring now to the accompanying drawings and initially to FIG. 1, the yarn threading apparatus of the present invention is broadly indicated at 10 as preferably incorporated in a textile yarn creel, shown generally at 12, of the type equipped with a plurality of yarn transport tubes, individually and collectively indicated herein by 14, for feeding a corresponding plurality of individual yarns Y from yarn packages P supported on the creel 12 to an associated textile machine, e.g., a circular knitting machine, indicated generally at 16. Creels of this type may be of varying particular constructions and configurations, the creel 12 being shown only schematically to be representative of substantially any conventional tube-type creel.

Basically, the creel 1 includes a plurality of upright yarn package-supporting frame members 18 (only one of which is shown for simplicity), each package-supporting frame member 18 having a plurality of outwardly-extending pins or other suitable holders 22 spaced along its length for mounting of the yarn packages P. As will be understood, the plural yarn package-supporting members 18 are laterally spaced from one another in a linear, arcuate, circular or other suitable arrangement. The creel 12 further includes a plurality of tube-supporting frame members 20 corresponding in number to the package-supporting members 18, the tube-supporting members 20 being laterally spaced with respect to one another in substantially the same arrangement as the package-supporting members 18 with each tube-supporting member 20 being disposed in spaced facing relation to its associated package-supporting member 18.

In a conventional tube-type creel, an entrance end of an individual yarn transport tube 14 is affixed, e.g., by a suitable bracket or the like, directly horizontally adjacent each package holder 22 to receive yarn Y from the package P supported thereon for feeding through the tube to the associated textile machine. Conventionally, each yarn would be threaded through its respective yarn transport tube utilizing a hand-held air nozzle as above-described In contrast, under the present invention, the yarn threading apparatus 10 provides an individual valve assembly, indicated generally at 24, mounted to the tube-supporting member 20 directly horizontally adjacent each package holder 22. As more fully described below, the entrance end of each yarn transport tube 14 is attached to a respective one of the valve assemblies 24 to receive yarn from the adjacent package P on the package supporting member 18 for delivery to the textile knitting machine 16 in normal fashion. Further, each valve assembly 24 is operatively communicated with a source of pressurized air, e.g., such as conventionally provided in a typical textile mill, as representatively indicated at 26, for selectively directing pressurized air into the associated yarn transport tube 14 when necessary for threading yarn through the tube.

Figure 2:
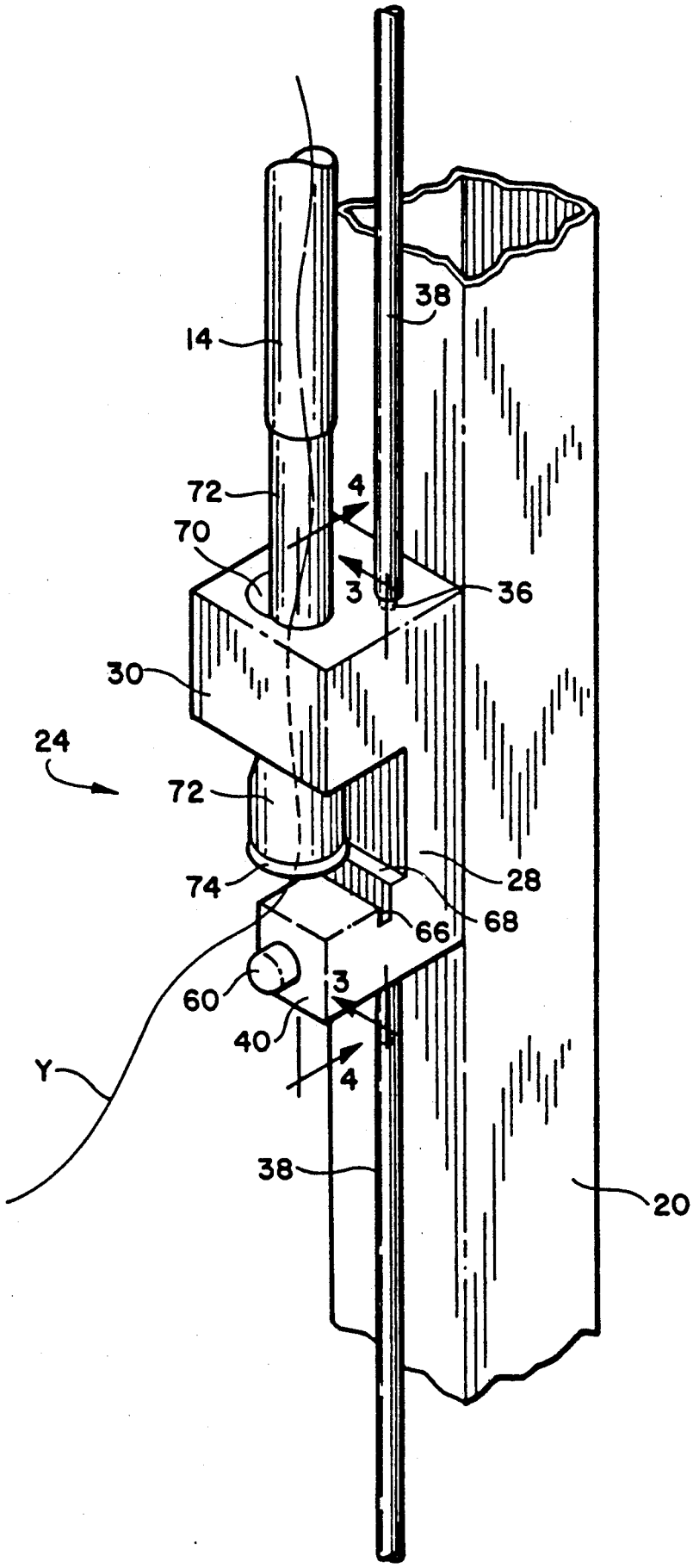
FIG. 2 is a perspective view of one of the valve assemblies of the yarn threading apparatus of FIG. 1.
Figure 3:
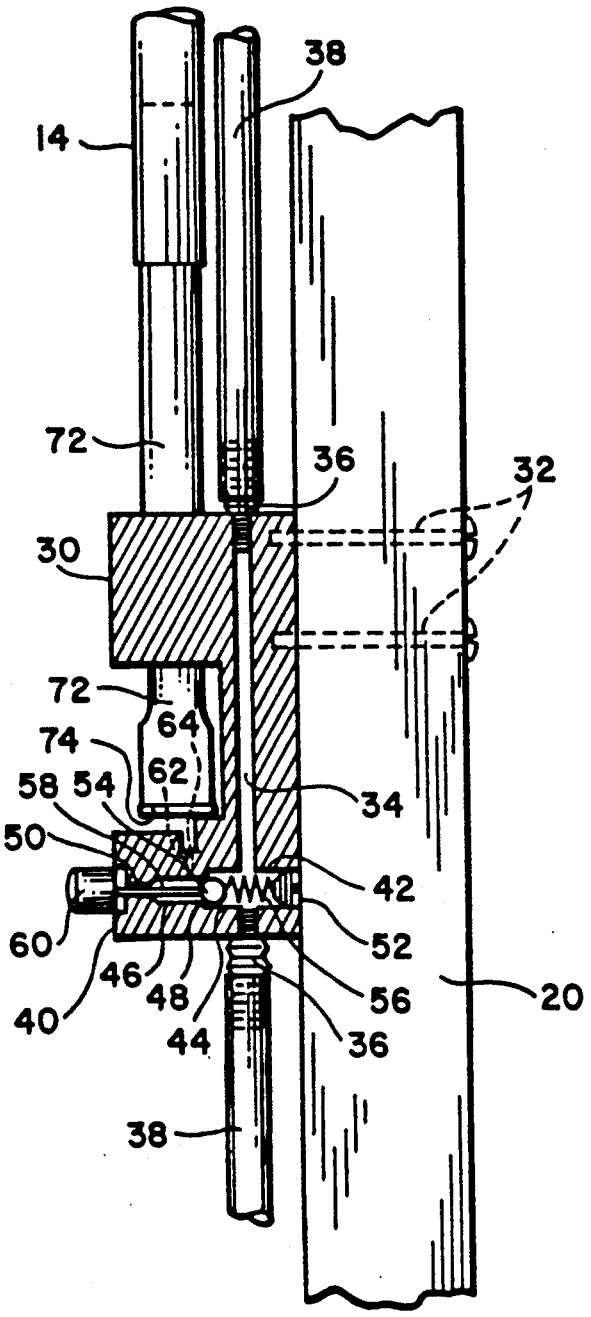
FIG. 3 is a vertical cross-sectional view of the valve assembly of FIG. 2, taken along line 3—3 thereof.
Figure 4:
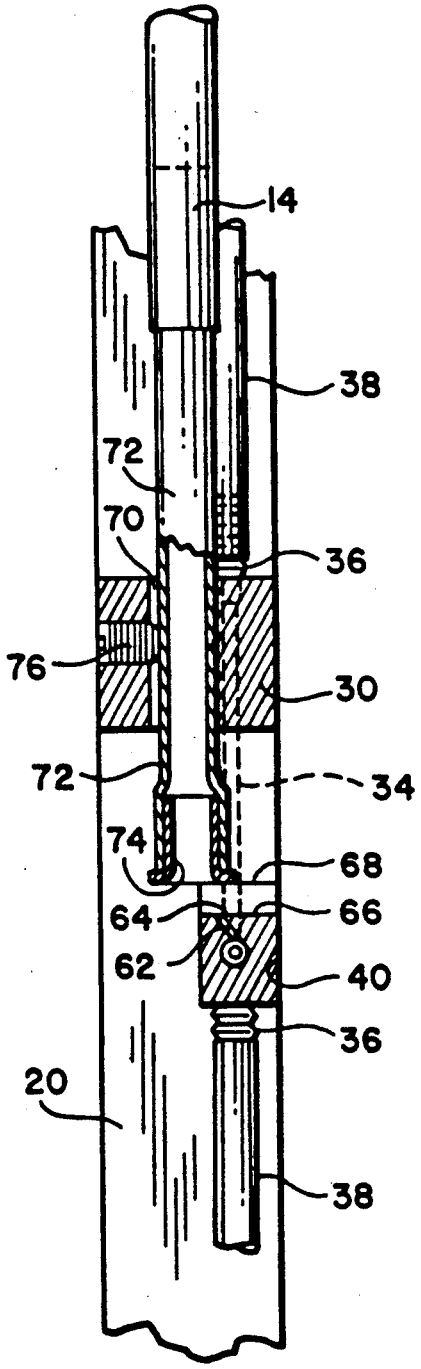
FIG. 4 is another vertical cross-sectional view of the valve assembly of FIG. 2, taken along line 4—4 thereof.

One of the valve assemblies 24 of the present invention is illustrated in detail in FIGS. 2-4. The valve assembly 24 includes a valve body 28 having an enlarged mounting portion 30 at its upper end for affixation of the valve assembly 24 at any selected location along the associated tube-supporting member 20. Substantially any suitable means may be utilized for attachment of the mounting portion 30 to the tube-supporting member 20, e.g., by mounting screws 32 as illustrated or by an appropriate mounting bracket or otherwise. A main air supply passageway 34 is formed through the entire vertical length of the valve body 28, with a pair of tubular nipple fittings 36 being threadedly supported in the valve body 28 in alignment with the passageway 34 at its upper and lower ends for communication therewith. As shown in FIG. 1, the main air supply passageways 34 of each valve body 28 mounted on a common tube-supporting member 20 are connected in series with one another by means of plastic tubes 38 extending between the upper and lower nipples of successively arranged valve assemblies 24, the upper nipple 36 of the uppermost valve assembly 24 on each tube-supporting member 20 being communicated directly to the pressurized air source 26 while the lowermost valve assembly 24 on each tube-supporting member 20 having the lower end of its main air supply passageway 34 closed.

The valve body 28 of each valve assembly 24 also includes a valve support portion 40 at its lower end opposite the mounting portion 30. The valve support portion 40 extends horizontally outwardly from the associated tube-supporting member 20 and has a valve bore 42 formed horizontally therethrough intersecting the main air supply passageway 34. The valve bore 42 has a rearward portion 44 of a relatively enlarged cross-sectional diameter which tapers to an intermediate section 46 of relatively smaller cross-sectional diameter forming a valve seat 48 therebetween, the intermediate portion 46 tapering further to a forward portion 50 of more reduced cross-sectional diameter. A set screw 52 is threadedly engaged in the rearward face of the valve body to close the rearward portion 44 of the bore 42. A valve ball 54 is movably disposed within the rearward bore portion 44 along with a biasing spring 56 extending between the set screw 52 and the valve ball 54 for urging the ball 54 into sealing engagement with the valve seat 48. A needle-type valve stem actuator 58 extends slidably through the intermediate and forward sections 46,50 of the valve bore 42 for sliding movement toward and away from the ball 54 to selectively displace the ball 54 out of sealing engagement with the valve seat 48 against the biasing force of the spring 56. The forward end of the valve stem 58 projects outwardly from the valve bore 42 and has an enlarged head 60 affixed thereto to permit manual actuation of valve opening and closing movement of the actuator stem 58.

A discharge bore 62 extends through the valve support portion 40 of the valve body 28 angularly upwardly from the intermediate portion 46 to a discharge opening 64 at the upwardly facing side of the valve support portion 40. A recessed yarn slot 66 is formed in the upwardly facing surface of the valve support portion 40 laterally thereacross to intersect the discharge bore 62, whereby the discharge opening 64 opens into the yarn slot 66. The upwardly facing surface of the valve support portion 40 further includes an elevated shoulder 68 rearwardly of the yarn support slot 66.

An enlarged bore 70 is formed vertically through the mounting portion 30 of the valve body 28 at a partial lateral offset from the valve support portion 40 of the valve body 28. A tubular yarn guide fitting 72, preferably formed of a rigid metallic material with a ceramic yarn guide eyelet 74 mounted at the lower end of the fitting 72, extends downwardly through the bore 70 in the valve body mounting portion 30 with the eyelet 74 resting at one edge on the shoulder 68. The guide fitting 72 is rigidly retained in such disposition by a set screw 76 extending through the mounting portion 30 into engagement with the fitting 72. In such disposition, the central opening defined by the eyelet 74 is disposed slightly above and at a lateral offset from the discharge opening 64 in substantial alignment with the angular discharge bore 62. Thus, the valve support portion 40 does not interfere with normal travel of yarn Y from the respective package P into the eyelet 74. One end of a conventional plastic yarn transport tube 14 is fitted slidably about the upper end of the yarn guide fitting 72, from which the yarn transport tube 14 extends in conventional fashion upwardly to the top of the creel 12 and therefrom overhead to the associated knitting machine 16.

The operation of the present yarn threading apparatus 10 may thus be understood. When it is necessary to thread any yarn Y from one of the packages P through its associated yarn transport tube 14, the leading end of the yarn Y from the package P is placed in the yarn slot 66 of the associated valve assembly 24, whereby the yarn end overlies the discharge opening 64 in the valve support portion 40 of the valve body 28. In the normal disposition of the valve ball 54 resting in sealing engagement with the valve seat 48 under the biasing force of the spring 56, pressurized air from the pressurized air source 26 is prevented from entering the intermediate and forward portions 46,50 of the valve bore 42. However, upon depression of the head portion 60 of the valve actuator stem 58, the valve ball 54 is displaced out of sealing engagement with the valve seat 48 against the biasing force of the spring 56, thereby permitting a stream of the pressurized air to flow into and through the intermediate and forward portions 46,50 of the valve bore 42 and therefrom into and through the discharge bore 62. The pressurized air exits the discharge bore 62 through its discharge opening 64 at an upward angle through the yarn support slot 66 into the central opening of the eyelet 74 and therefrom into and through the yarn guide fitting 72 and the associated yarn transport tube 14. The stream of pressurized air thereby carries with it the leading end of yarn Y previously placed in the yarn support slot 66 and entrains the yarn Y in the air stream as it flows through the yarn guide fitting 72 and the yarn transport tube 14 to convey the yarn Y through the entire length of the tube 14. When the operator recognizes visually that the yarn Y has exited the opposite end of the yarn transport tube 14, the operator releases the head portion 60 of the valve actuator stem 58 to permit the valve ball 54 to return to sealing engagement with the valve seat 48, thereby terminating the flow of pressurized air. The yarn end may then be threaded as necessary through the operating components of the knitting machine 16.

When initially setting up the creel 12, this operation may be quickly and easily accomplished for each yarn package P mounted on the creel 12, thereby considerably simplifying and shortening the set-up process in comparison to the conventional use of a hand-held air nozzle. Likewise, such operation considerably facilitates and improves the convenience of re-threading any individual yarn Y following a yarn breakage during the ongoing operation of the creel 12. Advantageously, therefore, the yarn threading apparatus reduces the time and operator involvement required for threading yarns through yarn transport tubes and, in turn, improves the operating efficiency of the associated textile machine which is supplied with the yarns.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example, one contemplated alternative embodiment of the present invention would be to mount the valve assemblies, or comparable suitable valve assemblies, at the exit ends of the yarn transport tubes in association with a source of suction rather than compressed air for drawing yarn ends through the tubes by suction force. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile yarn creel having a plurality of yarn package support locations and a respective plurality of yarn transport tubes, each tube extending from an entrance end disposed in association with a respective one of said package support locations to an exit end disposed at a remote yarn delivery location, the improvement comprising apparatus for threading a respective yarn through each yarn transport tube, said yarn threading apparatus including means for generating a moving gaseous stream, and a plurality of selectively openable and closeable fluid-transmitting valve means, each valve means being operatively associated with a respective one of said tubes for fluid communication interiorly therewith in the open condition of the valve means and each valve means being operatively communicated with said generating means for selectively directing a gaseous stream to flow through the respectively associated tube in the open condition of the valve means for entraining a yarn at the entrance end of the tube to thread the yarn through the tube, said plurality of valve means being arranged in groups each comprising a subplurality of said valve means, said generating means being operatively communicated with each said group of valve means to direct a common gaseous stream in series to the individual valve means in the respective group.

2. Yarn threading means for a textile yarn creel according to claim 1 and characterized further in that said generating means comprises a source of pressurized gas.

3. Yarn threading means for a textile yarn creel according to claim 2 and characterized further in that each valve means is mounted at the entrance end of its respectively associated tube.

4. Yarn threading means for a textile yarn creel according to claim 3 and characterized further in that each valve means comprises means for retaining the entrance end of the respectively associated tube.

5. Yarn threading means for a textile yarn creel according to claim 3 and characterized further in that each valve means comprises a gas discharge opening directed into the entrance end of its respectively associated tube.

6. Yarn threading means for a textile yarn creel according to claim 5 and characterized further in that said discharge opening is offset laterally from the center of the entrance end of the respectively associated tube.

7. Yarn threading means for a textile yarn creel according to claim 5 and characterized further in that each valve means comprises a yarn-receiving slot for supporting a leading end portion of a yarn to be threaded through the respectively associated tube, said discharge opening terminating at said slot for directing the gaseous stream into entraining contact with the yarn.

8. Yarn threading means for a textile yarn creel according to claim 5 and characterized further in that each valve means comprises a surface for supporting the entrance end of the respectively associated tube in a predetermined position relative to said discharge opening.

9. Yarn threading means for a textile yarn creel according to claim 3 and characterized further in that said creel comprises a plurality of upright package-supporting frame members each having a plurality of package holder elements spaced therealong and a plurality of upright tube-supporting members laterally spaced from said package-supporting frame members in facing relation thereto, each said valve means and the entrance end of its respectively associated tube being mounted to a respective one of said tube supporting members in laterally adjacent facing relation to a respective one of said holder elements.

10. Yarn threading means for a textile yarn creel according to claim 9 and characterized further in that the valve means commonly mounted to one said tube supporting means comprise one said group of valve means.

11. In a textile yarn creel having a plurality of yarn package support locations and a respective plurality of yarn transport tubes, each tube extending from an entrance end disposed in association with a respective one of said package support locations to an exit end disposed at a remote yarn delivery location, the improvement comprising apparatus for threading a respective yarn through each yarn transport tube, said yarn threading apparatus including a source of pressurized gas, and a plurality of selectively openable and closeable fluid-transmitting valve means, each valve means being mounted at the entrance end of a respective one of said tubes and having a gas discharge opening directed thereinto for fluid communication interiorly therewith in the open condition of the valve means and each valve means being operatively communicated with said pressurized gas source for selectively directing a gaseous stream to flow through the respectively associated tube in the open condition of the valve means for entraining a yarn at the entrance end of the tube to thread the yarn through the tube, each said valve means being offset laterally from the center of the entrance end of the respectively associated tube to avoid interference with normal travel of yarn from the respective package support location into the entrance end of the respective tube.

12. Yarn threading means for a textile yarn creel according to claim 11 and characterized further in that each valve means comprises means for retaining the entrance end of the respectively associated tube.

13. Yarn threading means for a textile yarn creel according to claim 11 and characterized further in that each valve means comprises a yarn-receiving a slot for supporting a leading end portion of a yarn to be threaded through the respectively associated tube, said discharge opening terminating at said slot for directing the gaseous stream into entraining contact with the yarn.

14. Yarn threading means for a textile yarn creel according to claim 11 and characterized further in that each valve means comprises a surface for supporting the entrance end of the respectively associated tube in a predetermined position relative to said discharge opening.

15. Yarn threading means for a textile yarn creel according to claim 11 and characterized further in that said creel comprises a plurality of upright package-supporting frame members each having a plurality of package holder elements spaced therealong and a plurality of upright tube-supporting members laterally spaced from said package-supporting frame members in facing relation thereto, each said valve means and the entrance end of its respectively associated tube being mounted to a respective one of said tube supporting members in laterally adjacent facing relation to a respective one of said holder elements.

* * * * *

UNITED STATES PATENT AND TRADEMARK OFFICE

CERTIFICATE OF CORRECTION

PATENT NO. : 5,024,393

DATED : June 18, 1991

INVENTOR(S) : Alan Gutschmit

It is certified that error appears in the above-identified patent and that said Letters Patent is hereby corrected as shown below:

Column 3, Line 24, reads "creel 1" but should read -- creel 12 --.

Column 3, Line 50, after "above-described" add -- . --.

Column 8, Line 25, after "yarn-receiving" delete -- a --.

Signed and Sealed this

Twenty-second Day of December, 1992

*Attest:*

DOUGLAS B. COMER

*Attesting Officer*

*Acting Commissioner of Patents and Trademarks*